United States Patent [19]

Holder et al.

[11] Patent Number: 4,797,687

[45] **Date of Patent: * Jan. 10, 1989**

[54] PATTERNING EFFECTS WITH FLUID JET APPLICATOR

[75] Inventors: Joseph P. Holder, Greensboro; Michael I. Glenn, Burlington; Bobby L. McConnell; Louis A. Graham, both of Greensboro, all of N.C.

[73] Assignee: Burlington Industries, Inc., Greensboro, N.C.

[ * ] Notice: The portion of the term of this patent subsequent to Mar. 17, 2004 has been disclaimed.

[21] Appl. No.: 26,413

[22] Filed: Mar. 16, 1987

Related U.S. Application Data

[60] Continuation-in-part of Ser. No. 908,289, Sep. 17, 1986, which is a division of Ser. No. 729,412, May 1, 1985, Pat. No. 4,650,694.

[51] Int. Cl.[4] ..... G01D 15/18

[52] U.S. Cl. ..... 346/1.1; 346/75; 427/262

[58] Field of Search ..... 346/75, 140, 1.1; 118/696; 427/262, 267, 274, 32; 101/211, 426; D5/43, 57, 62

[56] References Cited

U.S. PATENT DOCUMENTS

| | | | |
|---|---|---|---|
| 3,373,437 | 3/1968 | Sweet | 346/75 |
| 3,787,881 | 1/1974 | Duffield | 346/75 |
| 3,909,831 | 9/1975 | Marchio et al. . | |
| 3,915,113 | 10/1975 | Paton | 118/7 |
| 4,013,037 | 3/1977 | Warning, Sr. et al. . | |
| 4,032,978 | 6/1977 | Wong | 358/298 X |
| 4,065,773 | 12/1977 | Berry . | |
| 4,087,825 | 5/1978 | Chen et al. . | |
| 4,090,205 | 5/1978 | Huffman | 346/75 |
| 4,164,001 | 8/1979 | Patnaude . | |
| 4,167,151 | 9/1979 | Muraoka et al. . | |
| 4,250,510 | 2/1981 | Dressler | 346/75 |
| 4,287,522 | 9/1981 | Meyer | 346/75 |
| 4,326,204 | 4/1982 | Erin | 346/75 |
| 4,357,900 | 11/1982 | Buschor . | |
| 4,389,969 | 6/1983 | Johnson . | |
| 4,389,971 | 6/1983 | Schmidt . | |
| 4,417,255 | 11/1983 | Furukawa . | |
| 4,523,202 | 6/1985 | Gamblin | 346/75 |
| 4,563,688 | 1/1986 | Braun . | |
| 4,575,730 | 3/1986 | Logan et al. . | |
| 4,587,528 | 5/1986 | Beaudet . | |
| 4,596,990 | 6/1986 | Hou . | |
| 4,644,369 | 2/1987 | Gamblin | 346/75 |
| 4,650,694 | 3/1987 | Dressler | 346/75 X |

FOREIGN PATENT DOCUMENTS 2062787 12/1970 Fed. Rep. of Germany .

OTHER PUBLICATIONS

Daring et al.; Multiple-Nozzle Ink Jet Printing Experiment; IBM J. Res. Develop, vol. 28, No. 3, May 1984, pp. 300–306.

Meyer et al., "Ink Jet Printing—A New Possibility in Textile Printing", *Melliand Textiberichte,* English Ed., Feb. 1977, pp. 162–164; 255–261, (also attached is a German version of the article providing the drawings referred to in the article).

*Primary Examiner*—Joseph W. Hartary

*Attorney, Agent, or Firm*—Nixon & Vanderhye

[57] ABSTRACT

The electrostatic fluid jet applicator of the present invention achieves patterning effects with an applicator designed to provide a uniform solid application of liquid onto substrates. The applicator requires no digital memory device to store extensive image data defining patterns to be printed and includes a single ganged charging electrode which is utilized to simultaneously charge (or not charge) droplets emanating from a linear array of orifices. The applicator generates patterning effects primarily by controlling the application of charging voltage to the single electrode and by controlling the print time.

24 Claims, 5 Drawing Sheets

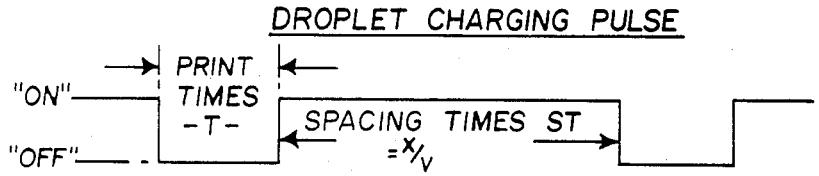
v = VELOCITY OF SUBSTRATE IN MACHINE DIRECTION
x = SPACING BETWEEN PIXEL CENTERS
T = PRINT TIME – 200 μs ≈ T MIN. ≤ T
V = VOLUME OF FLUID DELIVERED TO THE SUBSTRATE PER UNIT AREA – $1/\propto T/(T+ x/v)$
Δp = PIXEL DIMENSION ALONG MACHINE DIRECTION
Δp = Tv
FIG. 2
FIG. 3
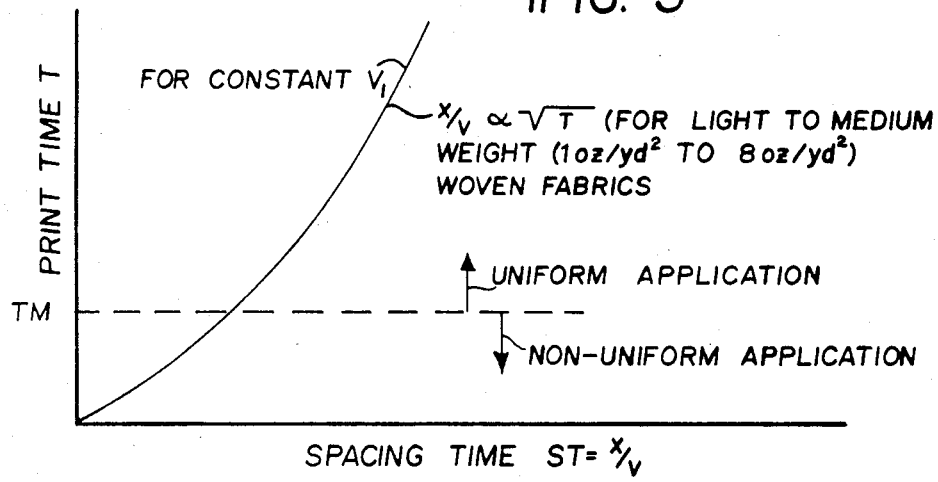
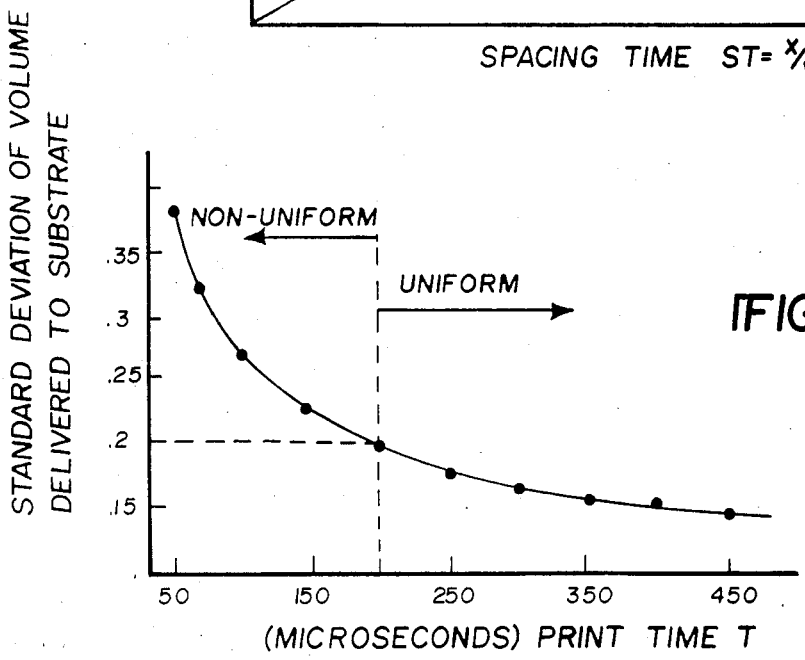
FIG. 4

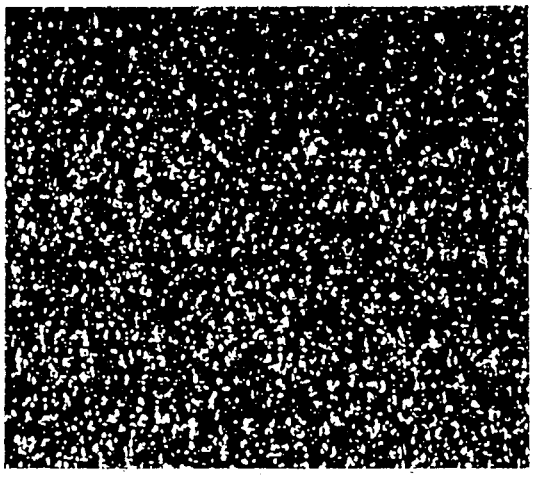
FIG. 6
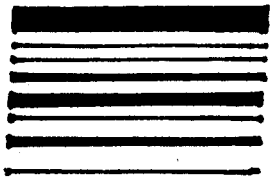
FIG. 5
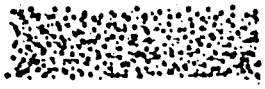
FIG. 7
FIG. 8
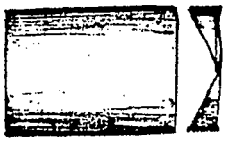
FIG. 11
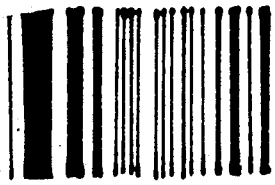
FIG. 12
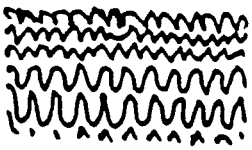

PATTERNING EFFECTS WITH FLUID JET APPLICATOR

RELATED APPLICATIONS

This application is a continuation-in-part of application Ser. No. 908,289 filed Sept. 17, 1986 which is a divisional of application Ser. No. 729,412, filed May 1, 1985.

FIELD OF THE INVENTION

This invention is directed to a method and apparatus for achieving patterning effects with an electrostatic fluid jet applicator designed to provide a uniform solid shade application of liquid onto substrate surfaces. This invention is particularly useful in the textile industry where such an applicator may be used to apply liquid dye throughout the surface and depth of a treated fabric substrate. Moreover, the applicator may be advantageously employed to apply patterns of the nature described herein to virtually any desirable substrate, e.g., wallpaper, contact paper, ceiling tile, etc.

BACKGROUND AND SUMMARY OF THE INVENTION

An electrostatic fluid jet applicator is designed to apply a fluid (e.g., a liquid dye) to a moving substrate (e.g., a fabric) by selectively charging and recovering some of the fluid droplets continuously ejected from a stationary linear array of orifices affixed transverse to the movement of the substrate, while allowing uncharged droplets to strike the substrate (e.g., thereby forming an image on the substrate).

In the prior art, electrostatic fluid jet applicators having pattern generating capability typically include an array of charge electrodes (e.g., one for each orifice jet in the array). In addition, the pattern to be printed is typically stored in an electronic digital memory in the form of picture elements (which are referred to as pixels). Lines of image data must be read out from the memory to an array of individual charge voltage control circuits to apply the appropriate control voltage to each individual charge electrode as determined by the image data. See U.S. Pat. No. 3,956,756, which is an example of an electrostatic fluid jet applicator having pattern generating capability.

Such pattern generating electrostatic fluid jet applicators are typically extremely expensive and may well possess more extensive pattern generating capabilities than some users need or desire.

The fluid jet applicator of the present invention can be controlled to uniformly apply solid shades to a fabric substrate, and to produce many different patterns. Yet, the applicator requires no digital memory device to store extensive image data defining each pixel of the patterns to be printed. Moreover, the applicator does not require individual pixel data to be fed to each charge electrode control circuit. Rather, the applicator of the present invention, may utilize simply a single elongated charging electrode which is utilized to simultaneously charge (or not charge) droplets emanating from each of the jets in the orifice array.

With regard to operating in the solid shade mode (and in regard to generating patterns having substantial solid shade portions), there is a need to uniformly apply fluid. The applicator of the present invention includes control circuitry for insuring uniformity when such is required.

It is contemplated for the present invention to be employed generally in the textile and other industries. The applicator of the present invention provides a solution to many of the formidable problems associated with, for example, applying fluid to an entire range of commercial fabrics.

As explained in the commonly-assigned copending U.S. Pat. No. 4,523,202 to Gamblin, if "ink" (actually many suitable liquid treatments may be used) jet electrostatic printing techniques are to be employed generally in the textile industry, random droplet formation processes may be utilized—as opposed to more conventional use of regular periodically stimulated droplet formation processes.

Even if conventional regular periodic stimulation is employed, there may still be a degree of randomness involved (especially when very short print times are considered).

In brief, the need for random droplet formation processes arises from the fact that typical textile applications may require cross-machine orifice arrays considerably in excess of the approximately only 8–10 inches cross-machine dimension typically utilized for printing onto paper of standard letter and legal sizes where regular periodically stimulated non-random droplet formation processes are purposely employed. When cross-machine dimensions much larger than 8–10 inches are required (e.g., perhaps up to approximately 1.8 meters in many typical textile applications), such regular periodic acoustic stimulation of the liquid so as to produce a non-random droplet formation process inevitably generates standing acoustic waves (or other adverse phenomena) within the applicator and/or liquid so as to generate undesirable variations in printing quality along the cross-machine dimension. For example "cusps" and/or "nulls" in the quantity of delivered liquid may form along the elongated cross-machine orifice array. To avoid such standing waves or other adverse phenomena (and thus permit longer cross-machine dimensions for single orifice arrays), Gamblin has proposed the purposeful employment of random droplet formation processes. As explained more fully in the above-referenced application, Gamblin proposes either (a) utilizing no stimulation at all (but even this probably inherently utilizes naturally occurring random acoustic vibrations or other ambient random processes to stimulate random droplet formation as described by Lord Rayleigh over a century ago) or (b) purposefully generating non-periodic (i.e., noise or pseudo-random) stimulations in the fluid jets issuing from orifices along a linear array of such orifices and thus causing a random droplet formation process to occur along the array. Since there are no coherent sources of regular periodic acoustic energy within the system, the maintenance of standing acoustic waves is necessarily avoided (i.e., because there are no regular travelling waves moving in opposite directions so as to constructively add and subtract thus forming cusps and nulls in a standing pressure wave pattern) nor are other such adverse phenomena permitted to exist. Typically, random or pseudo-random electrical signals are generated and fed to an electroacoustic transducer which is acoustically coupled to the liquid jets as they stream outward from the orifices.

In other words, there are situations in which it is either desirable or necessary to utilize random droplet formation processes within a liquid jet electrostatic applicator. The random drop formation processes may be entirely natural (i.e., totally without any artificial drop formation stimulation) or with use of a randomized artificial stimulation process. In this context, a single linear array of liquid jet orifices is typically employed to randomly generate a corresponding linear array of downwardly falling droplets formed at random time intervals and having a random distribution of droplet sizes. During a given "print time" interval, the droplets then passing by a charging electrode zone will not be charged and thus they will continue falling downward to impact with a substrate (e.g., a textile fabric) positioned therebelow (i.e., so as to be dyed, printed or otherwise treated by the liquid). Between such "print time" intervals, are located spacing time intervals during which the droplets are charged and subsequently deflected downstream in a further electrostatic field toward a droplet catching structure.

One of the reasons that liquid jet electrostatic applicators were thought to have potential advantage in the textile industry is that it was hoped that one might achieve a fairly tight control over the amount of fluid that is actually applied to the textile in a given treating process (e.g., dyeing). In many conventional textile liquid treatment processes, a considerable amount of excess "add-on" liquid is necessarily applied to the textile. Subsequently, much effort and expense are typically encountered in removing this excess fluid from the textile. For example, some of the excess might be physically squeezed out of the textile (e.g., by passage through opposed rollers) but much of it will have to be evaporated by heated air flows or the like. This requires considerable investment of equipment, energy, time and real estate. In addition, there is an obvious loss of the sometimes precious treating material itself—unless it is somehow recaptured and recycled which in itself involves yet further additional expense, effort, etc.

Accordingly, if one can somehow apply only the needed amount of liquid "add-on" treatment to a fabric, there is considerable economic advantage to be had.

At the same time, in many applications (e.g., textile dyeing operations), the treating liquid must be uniformly distributed throughout the treated substrate if one is to achieve a commercially acceptable product. Furthermore, in typical commercial environments, it will be necessary for a single apparatus to successfully treat a wide variety of different types of textile substrates each having different requirements if one is to achieve uniformity.

For example, for solid shade dyeing in textile applications, the liquid jet applicator must be able to apply fluid in a uniform fashion to an entire range of commercial fabrics. Different styles of fabric vary considerably in terms of fiber content, yarn size, construction, weave and preparation. These general parameters, when combined, in turn determine relative physical properties and characteristics of a given fabric such as porosity, weight, wetability, capillary diffusion (wicking) and the like. As will be appreciated, the volume of fluid per unit surface area required to adequately treat a given fabric is greatly influenced by these physical properties.

In order to control the volume of liquid per unit area passing onto the substrate moving therepast in a liquid jet electrostatic applicator, it was initially thought that one would merely have to control the duty cycle or "print time" of a fixed repetitive total cycle time interval (assuming a constant substrate velocity). That is, if a given print time is assumed to deposit a "packet" of droplets to form a corresponding printed "pixel" (i.e., a "picture element") on the substrate, and if the center-to-center pixel spacing is fixed at some predetermined small increment (e.g., 0.010 inch or 0.016 inch), then it was initially assumed that one merely had to control the volume of liquid deposited in each such closely-spaced pixel area to control the overall volume of applied liquid per unit area.

However, when actual laboratory experiments were run and applied "add-on" fluid volumes were thus controlled, it was found necessary to reduce the print time to durations of relative small magnitudes (e.g., on the order of 50–100 microseconds). In this manner, it was expected that only relatively small "packets" of droplets (hence small volumes of liquid) would impinge upon each of relatively closely-spaced center points in the textile medium such that the expected droplet spread diameter (typically wicking on the order of ten times the drop diameter can be expected in a fabric) would ultimately result in a uniform distribution of dyestuff within the textile medium.

Surprisingly, this straightforward approach did *not* produce uniform liquid applications. Instead, attempts to use this early approach revealed severe non-uniformity in the delivered liquid volumes along the linear orifice array. Further experiment and subsequent statistical analysis have revealed that the standard deviation of delivered liquid volumes along the linear orifice array increases exponentially as the print time interval is decreased. This result was evident not only in measured volumes of elements across the linear orifice array but also in the visual and optically measured appearance of dyed or printed textile substrates. It was discovered, for example, that when print time intervals on the order of 75–100 microseconds were employed (for center-to-center pixel spacings of 0.016 inch), volume variations in delivered liquid along the linear array are on the order of ±25%. Once this problem became apparent, it appeared to present a possibly insurmountable obstacle in the path of a desired uniform dye shade liquid jet electrostatic applicator machine using random droplet formation processes.

However, further consideration has led to a better understanding of the phenomena underlying this problem of apparent non-uniformity when print times are reduced significantly to controllably limit the average liquid volume per unit area being applied to the fabric. For example, although the term "random droplet formation processes" necessarily implies lack of regular or periodic droplet formation, nevertheless, a statistical average or mean droplet formation rate in such systems is predetermined by system parameters such as the liquid (e.g., its viscosity), the liquid pressure acting on the orifices, and the orifice diameter. For systems thought to be of interest in the textile industry, the mean or average random droplet formation rate is typically in the range of 20,000 to 50,000 drops per second (i.e., one drop every 20 to 50 microseconds). Once that fact is in hand, it can be seen that the relatively short print times of 50–100 microseconds earlier referenced mean that only a relatively few (e.g., two or three) droplets can, on the average, be expected to constitute the "packet" of droplets selected for printing purposes during such a short print time. Accordingly, random variations in the number of such droplets (e.g., the addition or subtraction of one such droplet) within a given print time interval will result in a considerable variation in the total volume of fluid delivered during a given unit print time interval. The result was the observed non-uniformity of printing volumes released along the linear orifice array at any given time and, therefore, deposited upon the imprinted fabric or other substrate medium.

Once these phenomena were better understood, it was then observed that improved uniformity of delivered liquid volume per unit distance along the orifice array could be obtained only by using print times in excess of approximately 200 microseconds (e.g., where the statistical standard deviation of volume delivered to the substrate is expected to be no more than about 0.2) with continued increases in uniformity being observed as the print time intervals were increased. Unfortunately, however, such increased print time intervals (now known to be necessary to achieve the desired uniformity of delivered liquid volume per unit distance along the linear array orifice) also increased the average overall volume being delivered per unit area of the textile substrate being dyed or printed. Such increases in delivered volume per unit area directly conflict with the desired advantage of providing only the optimum required amount of "add-on" liquid (e.g., low wet pickup dyeing of textiles) so as to avoid subsequent problems caused by the use of excess liquid volumes in the first place.

Even though the center-to-center pixel spacings on the substrate had earlier been selected and fixed for a given fabric at distances where the expected wicking or other diffusion processes would result in uniform distribution of applied liquid between the pixel centers, it was next theorized that since increased delivered volumes were now being supplied in each packet of droplets at a given pixel site, one might be able to move the pixel centers further apart and still maintain uniform final distribution—but now *without* the use of excess "add-on" liquid volume. That is, it was theorized that the above-stated problems might all be simultaneously overcome if one were to maintain relatively longer minimum print times (so as to average random variations in the number of droplets occurring along the linear array during any given print time) *coupled with* correspondingly longer elapsed time intervals *between* such print times (i.e., larger center-to-center pixel spacings). Further restated, the minimum amount of fluid being delivered to each pixel on the textile substrate during each print time was increased but the linear spacing on the substrate between such pixels was simultaneously increased so as to still achieve only the desired optimum overall volume/weight of liquid per unit area being delivered to the textile surface. (As will be appreciated, if the textile substrate is moved at a known given relative velocity in the longitudinal or "machine" direction, then the spacing interval distance on the substrate will also correspond to a known time interval).

Color uniformity of commercial fabric is judged not only across one surface, but also front-to-back, side-to-side and even within the thickness of the fabric. Overall color must be uniform in each of these areas for the product to be commercially acceptable. In normal "pad" dyeing, the pad pressure forces dye (i.e., by direct contact) into the fabric interior from both sides of the cloth. This assures that all areas of the substrate are exposed to the dye and results in uniform color throughout the fabric.

Liquid jet electrostatic application, on the other hand, being a non-contact form of application does not impart any significant mechanical work to the fabric in the dyeing process so as to aid in color distribution on the substrate. Rather, dye or color uniformity is achieved solely by movement of the fluid itself once it is deposited at a given location on the fabric surface. In textile applications, such movement is governed to a large extent by the physical properties and characteristics of the fabric as previously mentioned. These parameters determine how well a dye can move within the fabric microstructure and, thus, the degree to which the dye can become distributed within the fabric. Such parameters can differ drastically among fabrics.

Since fabric characteristics are to a large extent fixed by consumer demands, only the application parameters of the instrument are available for manipulation so as to assure uniform coloring of the fabric, these parameters being, for example, orifice size, print pulse width and pixel spacing. Orifice size and fluid pressure and the like are primarily set by the maximum fluid volume requirements so as to cover a given range of fabrics to be processed by a given machine setup. When operating in the solid shade mode, the desired degree of fluid "add-on" (i.e., the average volume per unit area of fluid delivered to the substrate surface) is controlled by maintaining the print pulse width above a predetermined minimum level while at the same time adjusting the center-to-center pixel spacing as may be required. In this manner, a greater range of fabrics may be satisfactorily treated by a single machine setup of a liquid jet electrostatic applicator utilizing random droplet formation processes.

The area of textile surface dyed or printed due to the impingement of a single packet of randomly formed droplets generated by a single orifice has been observed empirically to increase roughly as the square root of the selected print time. That is, for an increase of print time of 2X, a corresponding increase in the longitudinal or machine direction center-to-center spacing of pixels or print "packets" of droplets upon the substrate of 1.4142X would be required. This relationship is believed to be affected by the physical properties and characteristics of a given textile medium but has been observed to be generally true for light to medium weight (e.g., 1 to 8 ounces per yard) woven fabrics. In the exemplary embodiment, when operating in the solid shade mode, typical values of print times and longitudinal spacing range from 250 microseconds at 0.030 inch center-to-center pixel spacing to 550 microsecond print times at 0.040 inch center-to-center pixel spacing. It should be noted that these values are typical but in no way limit the scope of the invention in that each individual substrate will require its own distinct set of operating parameters.

These as well as other objects and advantages of this invention will be better appreciated by reading the following detailed description of the presently preferred exemplary embodiment taken in conjunction with the accompanying drawings.

BRIEF DESCRIPTION OF THE DRAWINGS

FIG. 2 is a schematic depiction of the relationship between repetitive print times T and spacing times ST for the apparatus of FIG. 1;

FIG. 3 is a graph showing the observed parabolic relationship between print time T and spacing time ST for constant delivered volumes V per unit area of the substrate;

FIG. 4 is a graph of empirical data showing the observed exponential relationship between the statistical standard deviation of liquid volume delivered to the substrate and print times T;

FIGS. 5–8, 11 and 12 are examples of some of the specific patterns which may be produced by the apparatus of FIG. 1;

DETAILED DESCRIPTION OF THE INVENTION

Figure 1:
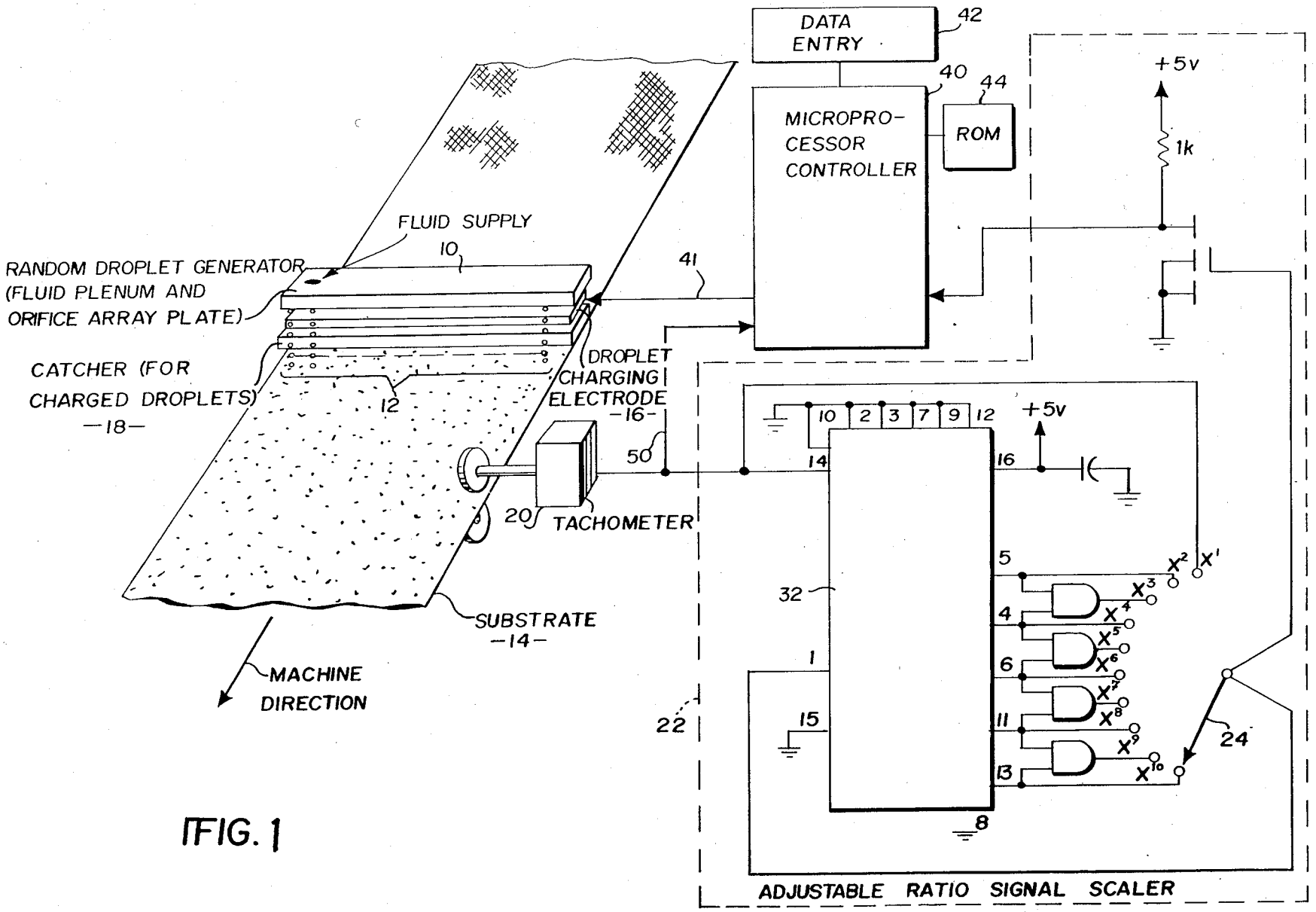
FIG. 1 is a a schematic depiction of a liquid jet electrostatic applicator using random droplet formation processes with appropriate circuitry for generating patterns and in solid shade applications, for controlling both the minimum print time interval and the frequency with which print pulses are generated as a function of distance along the substrate to be treated so as to control the average "add-on" volume of liquid per unit area applied to the substrate while yet achieving uniformity of such application.

An exemplary fluid jet electrostatic applicator for producing both solid shade and patterning effects is shown in FIG. 1. This applicator is a modified version of the solid shade applicator described in U.S. Pat. No. 4,650,694, which patent is hereby expressly incorporated by reference herein.

The applicator includes a random droplet generator 10. Typically, such a generator will include a suitable pressurized fluid supply together with a suitable fluid plenum which therein supplies a linear array of liquid jet orifices in a single orifice array plate (which may, for example, be the orifice plate disclosed in U.S. Pat. No. 4,528,070) disposed to emit parallel liquid streams or jets which randomly break into corresponding parallel lines of droplets 12 falling downwardly toward the surface of a substrate 14 moving in the machine direction (as indicated by an arrow) transverse to the linear orifice array. A droplet charging electrode 16 is disposed so as to create an electrostatic charging zone in the area where droplets are formed (i.e., forming the jet streams passing from the orifice plate). If the charging electrode 16 is energized, then droplets formed at that time within the charging zone will become electrostatically charged. A downstream deflection electrode (not shown) generates an electrostatic deflection field for deflecting such charged droplets into a catcher 18 where they are typically collected, reprocessed and recycled to the fluid supply. In this arrangement, only those droplets which happen *not* to get charged are permitted to continue falling onto the surface of substrate 14.

The random droplet generator 10 may employ absolutely no artificial droplet stimulation means or, alternatively, it may employ a form of random, psuedo-random or noise generated electrical signals to drive an electroacoustic transducer or the like which, in turn, is acoustically coupled to provide random droplet stimulation forces. It may also employ regular periodic stimulation which inherently includes a certain degree of randomness. As previously explained, such random droplet generating forces are often preferred so as to avoid standing waves or other adverse phenomenon which may otherwise limit the cross-machine dimensions of the linear orifice array extending across the moving substrate 14.

As also explained above, in solid shade applications and in certain of the patterning effects to be described below, it is very desirable (especially in the context of textile applications) to achieve a uniform application of a controlled liquid volume per unit area of substrate so as to avoid the application of any "excess" treating liquid and the attendant problems otherwise to be encountered.

To achieve the necessary control and also achieve the desired uniformly treated textile substrate, the system of FIG. 1 provides an apparatus for electronically adjusting the center-to-center pixel spacing between occurrences of individual print time pulses along the longitudinal or machine direction of substrate motion so as to provide a uniform solid shade dye or other fluid application (or even simply to provide uniformity within the solid portions of a given pattern application) by one or all of the ink jets within the linear orifice array, so as to make the apparatus usable on a relatively wider range of commercially desirable textile products. This adjustment of center-to-center pixel spacing in conjunction with proper control over the print time duration at each pixel site provides the desired result.

In particular, in the exemplary embodiment of FIG. 1, a tachometer 20 is mechanically coupled to substrate motion. For example, one of the driven rollers of a transport device used to cause substrate motion (or merely a follower wheel or the like) may drive the tachometer 20. In the exemplary embodiment, the tachometer 20 may comprise a Litton brand shaft encoder Model No. 74BI1000-1 and may be driven by a 3.125 inch diameter tachometer wheel so as to produce one single pulse at its output for every 0.010 inch of substrate motion in the longitudinal or machine direction. It will be appreciated that such signals will also occur at regular time intervals provided that the substrate velocity remains at a constant value. Accordingly, if a substrate is always moved at an approximately constant value, then a time driven clock or the like possibly may be substituted for the tachometer 20 as will be appreciated by those in the art.

Thus, by one means or another, an input signal is applied to the adjustable ratio signal scaler 22 for each passage of a predetermined increment of substrate movement in the machine direction (e.g., for each 0.010 inch). The ratio between the number of applied input signals and the number of resulting output signals from the signal scaler 22 is adjustable (e.g., by virtue of switch 24).

When an output signal is produced by the signal scaler 22, then a conventional print time controller as, for example, shown in the above-mentioned U.S. Pat. No. 4,650,694, generates a print time pulse for the charging electrode 16 (which actually turns the charging electrode "off" for the print time duration in the exemplary embodiment). The print time controller in application Ser. No. 729,412 was identified as being, for example, a monostable multivibrator with a controllable period by virtue of, for example, a potentiometer which may constitute a form of print time duration control. In the aforementioned application, a fixed resistor provides means to insure that there is always a minimum duration to each print time pulse while a variable resistor provides a means for varying the duration of the print time pulse at values above such a minimum. This same apparatus may likewise be employed in the present invention to effect print time control.

Alternatively, in the present invention, the above-described functions of the print time controller and potentiometer of the aforementioned application may, by way of example only, be performed by a microprocessor based controller 40. Thus, during operation in the normal solid shade operating mode, when an output signal is produced by signal scaler 22, controller 40 generates a print time pulse for charging electrode 16. The controller 40 insures, as did the potentiometer in the aforementioned application, that there is always a minimum duration to each print time pulse while controllably varying the duration of the print time at values above the minimum. Controller 40 as noted above, includes a microprocessor, which, by way of example only, may be an Intel 8080.

As will be appreciated by those skilled in the art, the generated print time pulses will be conventionally utilized to control high voltage charging electrode supply circuits so as to turn the charging electrode 16 "on" (during the intervals between print times) and "off" (during the print time interval when droplets are permitted to pass on toward the substrate 14).

For any given setting of switch 24, there is a fixed center-to-center pixel spacing. For example, if tachometer 20 is assumed to produce a signal each 0.010 inch of substrate movement, and if switch 24 is assumed to be in the X1 position, then the center-to-center pixel spacing will also be 0.010 inch because the print time controller 40 will be stimulated once each 0.010 inch.

However, the input to the signal scaler 22 also passes to a digital signal divider circuit 32 (e.g., an integrated COS/MOS divided by "N" counter conventionally available under integrated circuit type No. CD4018B). The outputs from this divider 32 are used directly or indirectly (via AND gates as shown in FIG. 1) to provide input/output signal occurrence ratios of 1:1 (when the switch is in the X1 position) to 10:1 (when the switch is in the X10 position) thus resulting in output signal rates from the scaler 22 at the rate of one pulse every 0.010 inch to one pulse every 0.100 inch and such an output pulse rate can be adjusted in 0.010 inch increments via switch 24 in this exemplary embodiment. The FET output buffer VNOIP merely provides electrical isolation between the signal scaler 22 and the controller 40 while passing along the appropriately timed stimulus signal pulse to the controller 40. Thus, the center-to-center spacing of pixels in the machine direction can be instantaneously adjusted by merely changing the position in switch 24. As will be appreciated by those skilled in the art, there are many possible electrical circuits for achieving such independent but simultaneous control over center-to-center pixel spacing and the minimum duration of print time intervals. Expanded ranges of signal ratios as well as closer or even vernier increments of signal ratio adjustments may be utilized if desired.

If the apparatus of FIG. 1 is utilized for achieving uniform solid shade coloring (e.g., dyeing) of substrates (e.g., fabrics), then the center-to-center pixel spacing becomes a limiting factor when the distance between individual pixels become so great that one can now perceive discrete cross-machine lines on the substrate which do not properly converge (e.g., due to wicking characteristics of the fabric so as to produce uniform coverage). This upper limit on the center-to-center pixel spacing will vary, of course, from one fabric to another due to the different physical properties of such fabrics as earlier discussed.

The relationship between print times T and spacing times ST is depicted graphically in FIG. 2. As shown and as previously explained, the print time T occurs when the charging electrode 16 is turned "off". If one assumes that the velocity of the substrate in the machine direction is v and if one also assumes that the signal scaler 22 is set so as to produce a predetermined center-to-center pixel spacing x, then the spacing time ST is equal to x/v. As also previously explained, the print time T should be above about 200 microseconds so as to produce a standard deviation of delivered liquid volume along the array of less than approximately 0.2 (see FIG. 4). It should also be appreciated that the volume V of fluid delivered to the substrate per unit area is proportional to the duty cycle of print time which is $T/(T+x/v)$. Furthermore, if one assumes zero wicking capability of the substrate and theoretically perfect conditions otherwise, then the nominal pixel dimension along the machine direction p will be equal to Tv. In actuality, due to wicking and other phenomena, in the preferred exemplary embodiment of a uniform dye shade applicator in the fabric or textile industries, the applied liquid at each pixel location will itself become distributed throughout the fabric substrate and therefore there will be no discernible delineations between pixel areas in the finished product.

Referring to FIG. 3, as previously mentioned, it has been observed data that for a constant delivered fluid volume V, changes in spacing times ST should be approximately proportional to the square root of the print time T. This observation has been made for light-to-medium (1 ounce per square yard to 8 ounces per square yard) woven fabrics. As depicted in both FIGS. 3 and 4, it has also been empirically observed that non-uniformity in liquid application can be expected for print times T less than about 200 microseconds. Alternatively stated, in view of the observed data depicted in FIG. 4 of standard deviations of volume delivered to the substrate versus print time T, the non-uniformity can also be expected when such standard deviation of delivered volume exceeds about 0.2. As will be appreciated, the exact point at which liquid application changes from a non-uniform to uniform state is a somewhat subjective determination. However, based on empirical observations, the just-stated limits are approximate critical operational limits for the exemplary system. In this system, the orifice array comprised orifices of 0.0037 inch diameter spaced apart by 0.016 inch over a cross-machine dimension of 20 inches using either disperse or reactive dyes having a liquid viscosity of 1.2 cps with a fluid pressure of 4.5 psi and pseudo-random droplet stimulation with a statistical mean of about 19094 cycles per second and a standard deviation of about 2800 cycles per second.

As should now be appreciated, this invention permits one to use random droplet generating processes in a liquid jet electrostatic applicator (e.g., thus-permitting larger cross-machine dimensions for use in the textile industry) while simultaneously achieving commercially acceptable uniform liquid application (e.g., to a textile substrate having given characteristics) while also simultaneously avoiding the application of excess "add-on" liquid (e.g. dye stuffs) and thus providing a significant economic advantage (e.g. when applied to the textile industry). These same desirable simultaneous results can be achieved with a single liquid jet electrostatic applicator for a relatively wider range of fabric substrates by virtue of the adjustable ratio signal scaler 22 used in conjunction with the print time controller 40 as described above.

PATTERNING EFFECTS

As discussed above, the fluid jet applicator of the present invention does not include either an individual charge electrode associated with each orifice in the orifice array or a pattern memory in which image data is stored. Rather, the applicator of the present invention includes a single ganged charging electrode 16 which does not permit differential control over the printing from each orifice based on stored image data, as is typically the case in pattern generating fluid jet applicators.

Nevertheless, through electronic and other control techniques the fluid jet applicator of the present invention can be productively utilized to create a variety of patterns such as those which will be discussed in conjunction with FIGS. 5–8, and 11 and 12. It must be emphasized that the patterns to be described below are exemplary and should in no way be construed as limiting the scope of the present invention.

In order to conveniently control operation in the pattern generation mode, microprocessor 40, data entry terminal 42 and programmable read-only memory (PROM) 44 are utilized as follows. Each of the patterns to be produced are assigned an identifying digital code. Stored in the PROM 44 are the subroutines required to control the fluid jet applicator to generate a predetermined repetoire of patterns. An operator then keys in a pattern identifying code on data entry terminal 42. Upon receiving the identifying code, microprocessor 40 uses the code to address the PROM locations wherein the associated pattern subroutine is stored.

It must be emphasized that microprocessor control is not required to generate the patterns which are discussed below, but rather is only one approach to achieving this end. In the disclosure which follows the patterns shown in FIGS. 5–8, 11 and 12 will be described together with a control technique for generating at least one form of the pattern.

Turning first to the pattern shown in FIG. 5, cross-machine bands of color are applied to the substrate in a manner to insure uniformity across the width of the substrate using the solid shade control techniques discussed above. After operating in the solid shade mode for a predetermined period of time, the droplet array is placed in the full catch mode (e.g., by applying charging voltage to charge electrode 16) so that no color is applied for a subsequent period of time, followed by a further application of a cross-machine band, and so on.

Figure 9:
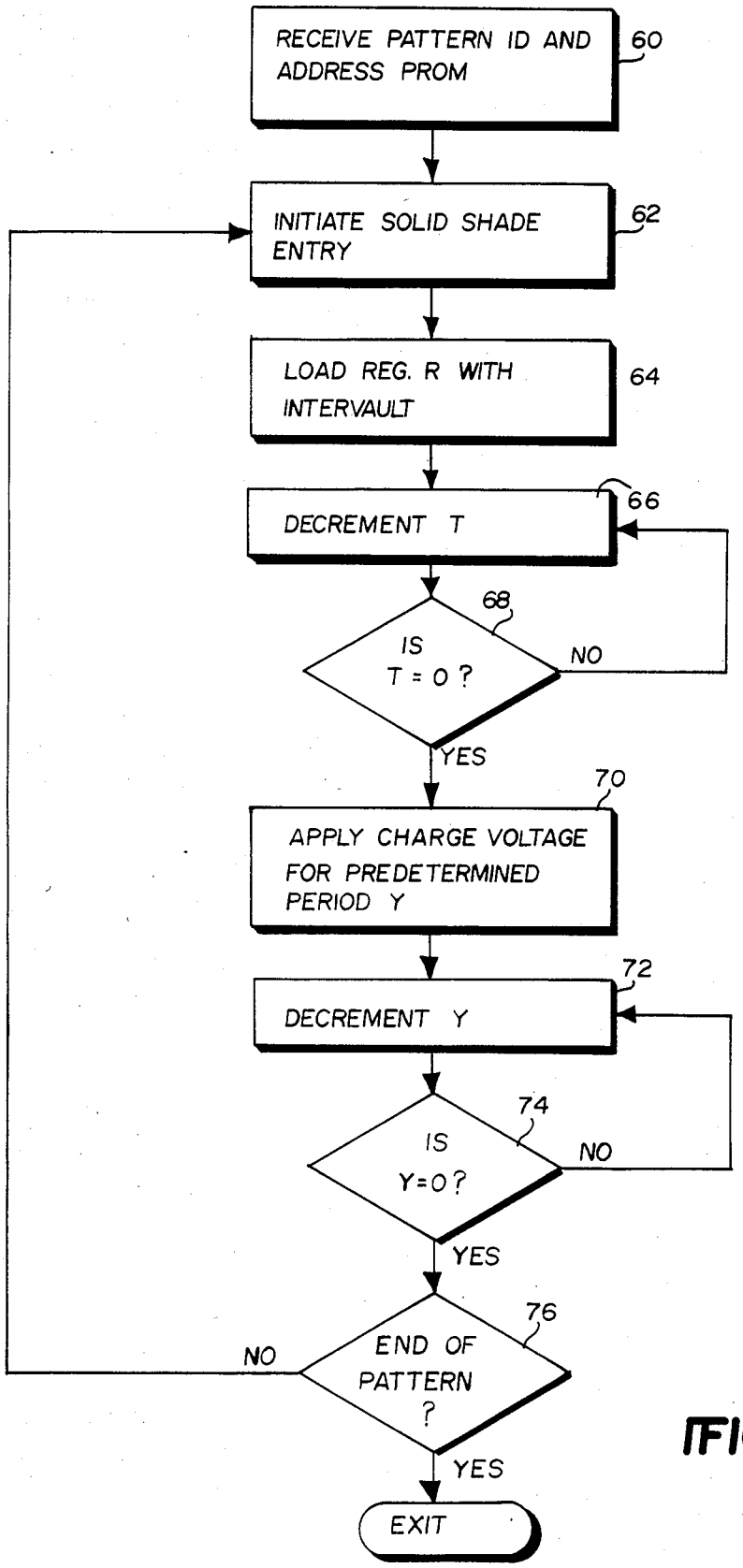
FIG. 9 is a flowchart which depicts the sequence of operations performed by controller 40 with respect to generating the pattern shown in FIG. 5.

As noted above, although microprocessor control is clearly not required to generate this pattern, microprocessor 40 may be utilized to generate this pattern as shown in FIG. 9. Upon sensing the entry of a pattern code from data entry terminal 42, controller 40 addresses the area in PROM 44 in which the subroutine is stored, and then begins executing the retrieved instructions (60). Next the controller 40 initiates normal solid shade control to insure uniformity of color within the band as described in detail above (62). A general register R of the controller 40 is then loaded with time interval data corresponding to the amount of time the controller is to remain in the solid shade mode to achieve a band of a width predetermined by the selected pattern (64). The contents of the register are then decremented until the time period has elapsed (66, 68).

Once the time period has elapsed, the controller 40 initiates the application of charge voltage to the charging electrode via line 41 for a predetermined period to place the applicator in a full catch mode (70). The time interval data Y (which is stored in one of the general registers in microprocessor 40) is decremented until the time period expires (72). After predetermined time period Y has lapsed (as determined in block 74), the controller 40 cycles back to solid shade control to print another band or exits the routine if the end of the pattern has been reached (76). As will be recognized by those skilled in the art, such a routine may be modified to include any of a number of additional features. For example, the routine may additionally provide for operator prompting to initially request data relating to the desired widths for bands and the spacing therebetween.

As shown in FIG. 6, a "heather" effect can be achieved by reducing the print time to a low level such that only a relatively small packet of droplets are released during such a print time. FIG. 6 is a copy of a photograph of the pattern produced on a paper substrate where the print time pulses were reduced to 80 microseconds while the center-to-center pixel spacing was 0.016 inch. This effect may be made more distinct by a further reduction in print time to achieve the effect shown in FIG. 7. In addition, with a two-head machine two colors can be applied in this same fashion to achieve further aesthetic effect. The heather color positions are completely random and non-repeatable, but the same "look" may be repeated. Indeed, a commercial order (e.g., a multi-roll order such as 10,000 yards) of such a heather fabric may all have the same "look", but absolutely no repeat of the pattern within the piece.

The fluid jet applicator further may be controlled to produce the tapered density pattern shown in FIG. 8. This effect may be obtained by varying the droplet packet size with time.

Figure 10:
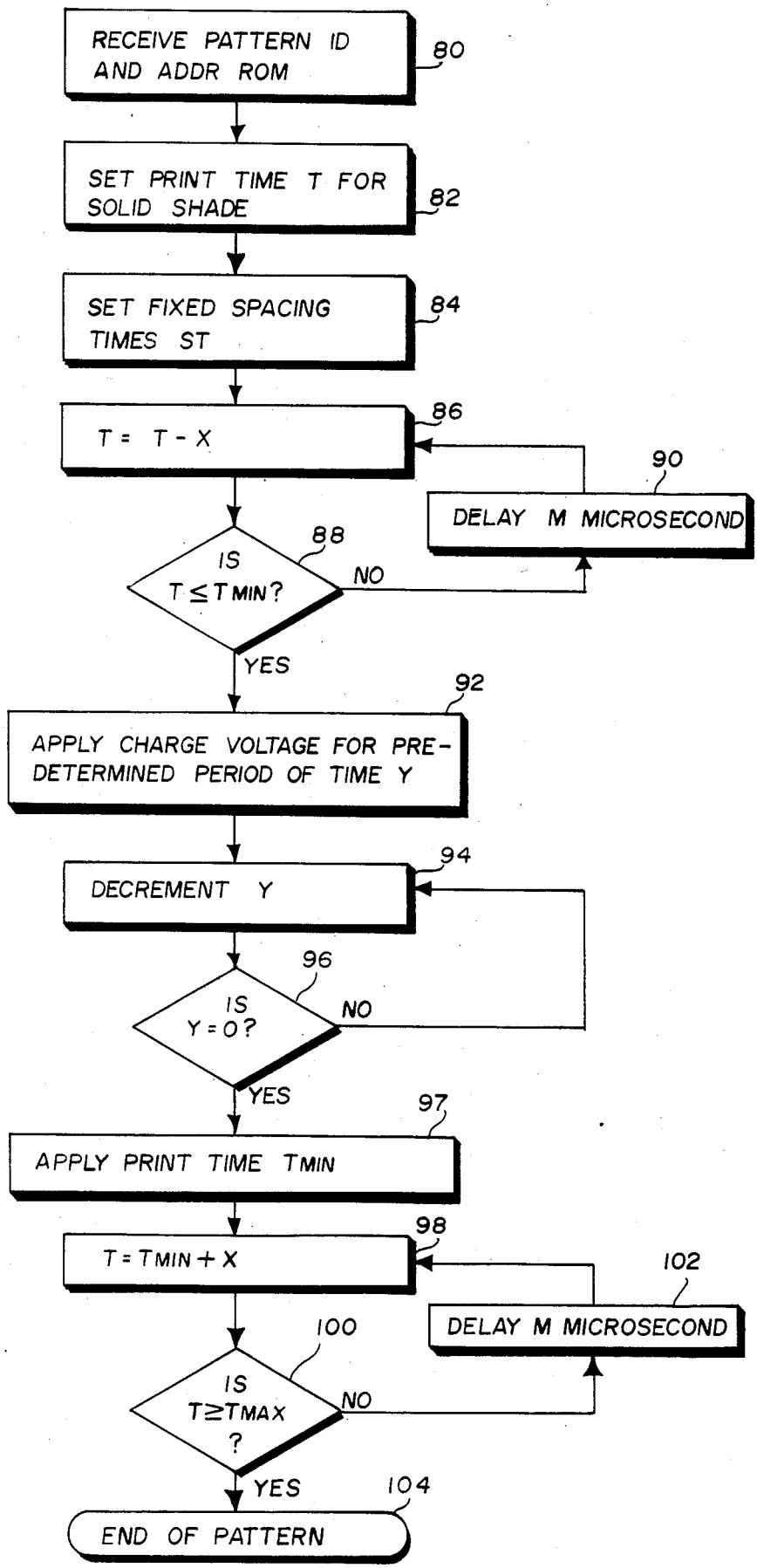
FIG. 10 is a flowchart which depicts the sequence of operations performed by controller 40 with respect to generating the pattern shown in FIG. 8.

As shown in FIG. 10, microprocessor controller 40, upon receiving the tapered density pattern identifier, addresses PROM 44 to access the tapered density subroutine (80). Initially, the microprocessor sets the print time T to the value required to achieve a solid shade at the very top of the pattern (82). Thereafter, a spacing time ST will is set which will not be varied throughout the pattern (84). The print time is then reduced by a predetermined increment X to thereby deliver fewer droplets per print time to reduce the density of the printed line (86). Next a check is made to determine whether the print time has been reduced to a predetermined minimum time (which corresponds to the end of the top tapered portion of the pattern) (88). If the minimum print time has not yet been reached, the print time is further reduced by an increment X after a brief delay (90) (to insure that the change in density does not occur too rapidly).

Upon the print time becoming equal or less than the minimum print time, charging voltage is applied for a predetermined period of time Y (92). The time period Y which is loaded in one of the microprocessor general registers is repeatedly decremented as shown in block 94.

Upon the expiration of the time period, the charging voltage is set to zero and a minimum print time is set (97). The print time is then gradually raised by the reverse process of that set forth above. In this regard, the print time is incrementally raised (98) and a check is made to determine whether the maximum print has been reached which serves to create the solid line at the bottom of the pattern (100). Before the maximum print time has been reached a delay is introduced (102) for the reason discussed above with respect to block 90. Once the maximum print time has been reached, the subroutine is exited (104) and the pattern shown in FIG. 8 is complete.

A still further pattern which may be generated by the fluid applicator of the present invention is shown in FIG. 11. This pattern is produced by the fluid applicator using normal solid shade control as described in detail above. The vertical stripes of this pattern are produced by using a specially designed orifice plate wherein only selected and variably spaced orifices are formed therein. As an alternative to manufacturing a variable hole plate, a typical orifice plate could be utilized after preselected orifices are blocked. Either way the orifice plate has a linear array of orifices not equally spaced from one another. In either event, the orifice plate must be such that no filament is discharged from preselected areas which are intended to define spaces between stripes.

A still further pattern which may be produced by the ganged electrode fluid jet applicator of the present invention is the "random interference" pattern shown in FIG. 12. In order to produce this pattern, artificial stimulation must be supplied to the fluid plenum in order to purposefully generate and exploit the acoustic standing waves therein. As a result, although droplets will be formed at substantially the same frequency from each orifice, individual droplets will be formed so as to be out of phase with their adjacent neighbors in accordance with the standing acoustic wave pattern. By selecting only a very short print time such that only one or two droplets are formed within such time (and by controlling the frequency of such print times), a wide range of such random interference patterns can be created. Patterns closely simulating natural wood grains including knot holes can be produced using this technique. Particular methods by which the fluid jet applicator of the type disclosed herein may be modified and controlled to produce these patterns are the subject of related application Ser. No. 026,488, filed Mar. 16, 1987, which application is hereby incorporated by reference.

As will be apparent to those skilled in the art, in addition to the basic patterns discussed above, many combinations of these patterns are within the scope by the present invention. In this regard, spaced squares or rectnngles can be provided by combining the techniques discussed with regard to FIGS. 5 and 11. That is, by using an orifice plate having selective holes plugged (or not included originally) will enable the applicator to generate machine directed colored stripes. As discussed with respect to FIG. 5, by selectively controlling the print window during which the machine applies these colors, the resulting stripes can be cut into spaced squares or rectangles.

In addition, the techniques discussed above with respect to FIGS. 7 and 8 may also be applied using a variable hole orifice plate. Furthermore, it can be seen that cross-machine stripes of varying tones and widths may likewise be produced using the techniques discussed above. Additionally, any of the patterns discussed above may be used in conjunction with the random interference pattern shown in FIG. 12 and discussed in detail in the above-mentioned copending application to produce a pattern on, for example, a simulated wood grain background.

While only a few presently preferred exemplary embodiments of this invention have been described in detail, those skilled in the art will recognize that many modifications and variations may be made in such exemplary embodiments while yet retaining many of the advantageous novel features and results. Accordingly, all such modifications and variations are intended to be included within the scope of the following claims.

What is claimed is:

1. A method of applying patterns to a moving substrate using an electrostatic fluids jet applicaotr which employs random drop formation processes, said applicator having a linear array of orifices extending along a transverse or cross-machine direction with respect to said substrate motion, means for selectively charging fluid droplets emanating from said orfice array including a single ganged electrode extending in said cross-machine direction, said means for charging fluid droplets operating to simultaneously charge or not charge all fluid droplets then being formed in an electrostatic charging zone disposed downstream of the orifices, said applicator including means for passing droplets onto said moving substrate only during controlled successive print times T, and not passing droplets onto said moving substrate during controlled time intervals between such successive print times, said method of applying patterns comprising the step of:

selecting a predetermined desired patterning effect to be generated from a plurality of distinct patterns which may be generated by said applicator;

setting said print time T to a predetermined value to initiate said desired patterning effect, simultaneously charging or not charging all fluid droplets in said electrostatic charging zone using said single ganged electrode, and controlling said electrostatic fluid jet applicator to apply a pattern to said substrate over a substantial length of substrate which pattern is not merely a solid shade by controllably varying at least one of said print times T and said controlled time intervals between print times to generate said desired patterning effect.

2. A method according to claim 1, wherein said setting step includes maintaining the print time T above a predetermined minimum value to uniformly cover a predetermined portion of said substrate for a predetermined period of time, and wherein said controlling step includes controllably applying charging voltage to said electrode for a predetermined period of time to prevent any droplets from striking the substrate.

3. A method according to claim 2, wherein said predetermined value is 200 microseconds.

4. A method according to claim 2, further including controlling the center-to-center spacing on said substrate between deposited packets of droplets to achieve a desired limited delivered liquid volume per unit area of substrate; and coordinating said controlled print time T and said controlled spacing so as to insure uniformity and solidity in liquid treatment of the substrate over at least a section thereof.

5. A method according to claim 2 further including the step of permitting droplets to strike the substrate after the expiration of said predetermined period of time.

6. A method according to claim 1, further including the step of gradually modifying said print time over a period of time to generate an area of 7. A method of applying patterns to a moving substrate using an electrostatic fluid jet applicator which employs ramdom drop formation processes, said applicator having a linear array of orifices extending along a transverse or cross-machine diretion with respect to said substrate motion, means for selectively charging fluid droplets emanating from said orifice array including a single ganged electrode extending in said cross-machine direction, said means for charging fluid droplets operating to simultaneously charge or not charge all fluid droplets then being formed in an electrostatic charging zone disposed downstream of the orfices, said applicator including means for passing droplets onto said moving substrate only during controlled print times T, said method of applying patterns comprising the step of:

setting said print time T to a predetermined value to initiate a desired patterning effect, simultaneously charging or not charging all fluid droplets in said electrostatic charging zone using said single ganged electrode; and controlling said electrostaic fluid jet applicator to apply a pattern to said substrate over a substantial length of substrate which pattern is not merely a solid shade, wherein the step of setting said print time includes setting the print time to below a predetermined minimum value to generate a speckled, heather pattern on the substrate.

8. A method of applying patterns to a moving substrate using an electrostatic fluid jet applicator which employs random droplet formation processes, said applicator having a linear array of orifices extending along a transverse or cross-machine direction with respect to said substraste motion, means for selectively charging fluid droplets emanating from said orfice array including a single ganged electrode extending in said cross-machine direction, said means for charging fluid droplets operating to simultaneously charge or not charge all fluid droplets then being formed in an electrostatic charging zone disposed downstream of the orifices, said applicator including means for passing droplets onto said moving substrate only during controlled print times T, said method of applying patterns comprising the step of:

installing an orifice plate having variably-spaced orfices in said fluid jet applicator;

setting said print time T to a predetermined value to initiate a desired patterning effect, simultaneously charging or not charging all fluid droplets in said electrostatic charging zone using said single ganged electrode, controlling said electrostatic fluid jet applicator to apply a pattern to said substrate over a substantial length of substrate which pattern is not merely a solid shade, wherein said setting step includes the step selecting a printing time sufficient to generate a solid shade; and wherein said controlling step includes the step of applying stripes to the substrate in the machine direction.

9. A method according to claim 8, further including the step of applying charging voltage to said electrode for a predetermined period of time after a solid shade has been applied to a predetermined portion of said substrate to generate at least one of spaced rectangles and squares.

10. A method according to claim 8, further including the step of gradually modifying said print time over a period of time to generate an area of tapered pattern density on said substrate.

11. A method according to claim 1, further including the step of controlling the generation of patterns with a data processor.

12. Electrostatic fluid jet apparatus for applying patterns to a moving substrate comprising:

means for radnomly forming liquid droplets along a linear array of orifices extending along a transverse or cross-machine direction with respect to said substrate motion;

means for charging fluid droplets emanating from said orfice array, said means for charging fluid droplets operating to simulataneously charge or not charge all fluid droplets then being formed in an electrostatic charging zone disposed downstream of the orifices and including a single ganged electrode extending in said cross-machine direction, means for selectively passing droplets according to their charge onto said moving substrate only during controlled successive print times T and selectively not passing droplets onto said moving substrate during controlled time intervals between sucessive print times T, means for setting said print time T to a predetermined value to intiate a desired patterning effect, and means for controlling said electrostatic fluid jet applicator to apply a pattern to said substrate over a substantial length of substrate which is not merely a solid shade by controllably varying at least one of said print time T and said time intervals between print times to thereby generate any one of a plurality of predetermined desired patterning effects.

13. An apparatus according to claim 12, wherein said means for setting includes means for maintaining the print time T above a predetermined minimum value to uniformly cover a predetermined portion of said substrate for a predetermined period of time, and wherein said means for controlling includes means for controllably applying charging voltage to said charging means for a predetermined period of time, to prevent any droplets from striking the substrate.

14. Apparatus according to claim 13, wherein said predetermined value is 200 microseconds.

15. Apparatus according to claim 12, further including means for controlling the center-to-center spacing on said substrate between deposited packets of droplets to achieve a desired limited delivered liquid volume per unit area of substrate; and means for coordinating said controlled print time T and said controlled spacing so as to insure uniformity and solidity in liquid treatment of the substrate over at least a section thereof.

16. Apparatus according to claim 13 further including means for permitting droplets to strike the substrate after the expiration of said predetermined period of time to thereby create a plurality of stripes in the cross-machine direction.

17. Apparatus according to claim 12, further including means for applying charging voltage to said charging means for a predetermined period of time after a solid shade has been applied to a predetermined portion of said substrate to generate at least one of a plurality of spaced rectangles and a plurality of squares.

18. Apparatus according to claim 17, further including means for gradually modifying said print time over a period of time to generate an area of tapered pattern density on said substrate.

19. Apparatus according to claim 12, wherein said means for controlling is a data processor.

20. A multiple mode fluid jet apparatus for applying fluid to a moving substrate comprising:

means for randomly forming liquid droplets along a linear array of orifices extending along a transverse or cross-machine direction with respect to substrate motion;

means for charging fluid droplets emanating from said orifice array, said means for charging droplets operating to simultaneously charge or not charge substantially all fluid droplets formed in an electrostatic charging zone disposed downstream of the orifice and including a single, ganged cross-machine electrode;

means for selectively passing droplets onto said moving substrate only during controlled print time T;

first means for controlling said applicator to operate in a first mode for applying to a substantial length of substrate a uniform, solid shade; and second means for controlling said applicator to operate in a second mode for applying to a substantial length of substrate any of a plurality of predetermined patterns.

21. Apparatus according to claim 20, said first means including means for controlling the center-to-center spacing on said substrate between deposited packets of droplets to achieve a desired limited delivered liquid volume per unit area of substrate; and means for coordinating said controlled print time T and said controlled spacing so as to insure uniformity and solidity in liquid treatment of the substrate over at least a section thereof.

22. Apparatus according to claim 20, wherein said second means includes means for setting said print time T to a predetermined value to initiate a desired patterning effect.

23. Apparatus according to claim 22, wherein said means for setting includes means for maintaining the print time T above a predetermined minimum value to uniformly cover a predetermined portion of said substrate for a predetermined period of time, and second means further including means for controllably applying charging voltage to said electrode for a predetermined period of time to prevent any droplets from striking the substrate.

24. Apparatus according to claim 22, wherein said second means includes means for gradually modifying said print time over a period of time to generate an area of tapering pattern density on said substrate.

* * * * *

UNITED STATES PATENT AND TRADEMARK OFFICE

CERTIFICATE OF CORRECTION

PATENT NO. : 4,797,687

DATED : January 10, 1989

INVENTOR(S) : JOSEPH P. HOLDER ET AL.

It is certified that error appears in the above-identified patent and that said Letters Patent is hereby corrected as shown below:

Column 1, line 8, insert --now U.S. Patent No. 4,650,694-- after "1985". Column 3, line 56, change "wetability" to --wettability--. Column 7, line 53, change "psuedo-random" to --pseudo-random--; line 61, change "phenomenon" to --phenomena--. Column 8, line 53, "application serial number 729,412" should read --U.S. Patent No. 4,650,694--. Column 11, line 23, change "repetoire" to --repertoire--. Column 12, line 36, change "is" to --be--. Column 13, line 40, change "rectnngles" to --rectangles--. Column 14, line 2, change "fluids" to --fluid--; line 2, change "applicaotr" to --applicator--; line 7, change "orfice" to --orifice--; line 59, complete Claim 6 by adding the following: --tapered pattern density on said substrate--; line 64, change "diretion" to --direction--. Column 15, line 25, change "substraste" to --substrate--; line 47, change "step selecting" to --step of selecting--; line 67, change "radnomly" to --randomly--. Column 16, line 4, change "orfice" to --orifice--; line 5, change "simulataneously" to --simultaneously--.

Signed and Sealed this

Twenty-eighth Day of November 1989

*Attest:*

JEFFREY M. SAMUELS

*Attesting Officer* *Acting Commissioner of Patents and Trademarks*